US005609964A

United States Patent [19]

Ogawa et al.

[11] Patent Number: 5,609,964

[45] Date of Patent: Mar. 11, 1997

[54] INK JET RECORDING SHEET AND METHOD FOR PRODUCING SAME

[75] Inventors: Susumu Ogawa; Hideaki Senoh; Kouji Idei, all of Tokyo, Japan

[73] Assignee: Mitsubishi Paper Mills Limited, Tokyo, Japan

[21] Appl. No.: 460,551

[22] Filed: Jun. 2, 1995

Related U.S. Application Data

[63] Continuation of Ser. No. 143,123, Oct. 29, 1993, abandoned.

[30] Foreign Application Priority Data

| | | | |
|---|---|---|---|
| Nov. 9, 1992 | [JP] | Japan | 4-298684 |
| Dec. 10, 1992 | [JP] | Japan | 4-330132 |
| Dec. 10, 1992 | [JP] | Japan | 4-330133 |

[51] Int. Cl.[6] ..... B41M 5/00

[52] U.S. Cl. ..... 428/520; 427/428; 428/195; 428/211; 428/535; 428/537.5

[58] Field of Search ..... 428/195, 537.5, 428/211, 913, 520, 534, 535; 427/428

[56] References Cited

U.S. PATENT DOCUMENTS

| | | | |
|---|---|---|---|
| 4,639,751 | 1/1987 | Mori et al. | 503/227 |

FOREIGN PATENT DOCUMENTS

| | | |
|---|---|---|
| 495591 | 7/1992 | European Pat. Off. . |
| 2-270588 | 11/1990 | Japan . |
| 4-298380 | 10/1992 | Japan . |

OTHER PUBLICATIONS

Derwent Abstract of JP–A 4–119881 (Sumitomo Naugattuck KK) (Apr. 21, 1992).

*Primary Examiner*—Pamela R. Schwartz
*Attorney, Agent, or Firm*—Armstrong, Westerman, Hattori, McLeland & Naughton

[57] ABSTRACT

Disclosed is an ink jet recording sheet which includes a support mainly composed of a wood pulp and a filler and provided with at least one ink-receiving layer with or without a backcoat layer wherein the ratio of gas permeability/density of the recording sheet is within a specific range. Further disclosed is a method for producing it. The ink jet recording sheet can provide images high in density, excellent in color quality and sharpness and less in feathering, is less in strike-through of ink and cockling and has good image reproducibility.

10 Claims, No Drawings

INK JET RECORDING SHEET AND METHOD FOR PRODUCING SAME

This application is a continuation of application Ser. No. 08/143,123, filed Oct. 29, 1993, now abandoned.

The present invention relates to an ink jet recording sheet and a method for producing same, and in particular to an ink jet recording sheet which prints high density images of graphics and characters and is excellent in ink absorbency thereby reducing substantially bleeding of ink in color overlapping portions and strike-through.

The ink jet recording method performs recording of graphics and characters by depositing ink droplets ejected by various working principles on a recording sheet such as paper. The ink jet recording has such favorable features that it makes high-speed recording possible, that it produces little noise, that it can easily perform multi-color recording, that there is no limitation as to kind of patterns or images, and that it requires no processing for development and fixing. Thus, the ink jet recording is rapidly becoming widespread in various fields as devices for recording various characters including kanjis (Chinese characters) and color images. Furthermore, the images formed by the multi-color ink jet recording method are not inferior to those printed by multi-color press or those obtained by color-photography. Besides, use of the ink jet recording extends to a field of full-color image recording where number of copies is not so many, since cost per copy are less than those employing the photographic process.

As for the recording sheets used for ink jet recording, efforts have been made from the aspects of printer hardware or ink compositions in order to use woodfree papers or coated papers used for ordinary printing or writing. However, improvements in recording sheets have come to be required increasingly in order to go side by side with developments in printer hardware such as ever increasing speed, development of ever finer definition images of full color, and also with expanding fields of uses. That is, recording sheets are demanded to develop ever high reproducibility image, and in order to meet that demand image density of the printed dots be maintained high, and hue characteristics be bright and appealing, the ink applied be fixed quickly and does not bleed or spread even though a different color ink is put over additionally. Moreover, the ink should set quickly, dots should not spread more than needed and the circumference of dots should be sharp and demarcating.

The ink jet recording sheets can be roughly classified into those of plain paper type such as wood free papers and bond papers where ink is absorbed also into the support and those of coated type comprising a support such as paper, e.g., wood free paper, synthetic paper or synthetic resin film and an ink-receiving layer provided thereon.

The ink jet recording sheets of the coated type include those of light coating weight—about 1–10 g/m$^2$, those of medium coating weight—about 10–20 g/m$^2$, and those of heavy coating weight—about 20 g/m$^2$ or more. In the case of commonly employed supports, i.e. paper composed mainly of pulp fibers and loading materials, there can be considered base papers of from 0 to several ten seconds in Stöckigt sizing degree. They are coated in various coating weight depending on the amount of ink to be deposited. The color image to be put on the recording sheet is not limited to monochromatic colors of yellow, magenta, cyan, black ink, and so on, but also can include the one that has mixed colors formed by disposing two or more different color inks. In such mixed color recording, the total amount of the inks disposed is large and it is necessary to use a base paper of relatively low sizing degree thereby to allow the support to absorb apart of the inks disposed.

Use of a low sizing degree base paper helps facilitate ink absorption, but tends to cause problems such as strike-through or cockling (wrinkles of paper). Ink-receiving layer is designed to facilitate absorption of an aqueous ink as quick as possible. This in turn tends to make it susceptible to humidity. That is, moisture causes differences in contraction and expansion between the support and the ink-receiving layer, resulting in curling of the sheet. As a result, runnability of the sheet on a recording device becomes poor.

In order to solve these problems, Japanese Patent Application Kokai No. 2-270588 proposes an ink jet recording sheet having ink-receiving layers on the front side and back side of a paper support. Japanese Patent Application Kokai No. 62-282967 discloses a sheet having an ink-holding and ink-transfer layers on a support, and further a curl inhibiting layer having properties same as or similar to those of the ink-holding layer. Furthermore, Japanese Patent Application Kokai No. 61-235184 discloses a recording material having an ink-receiving layer which is further provided with a curl inhibiting layer comprising a resin such as polyacrylamide. Japanese Patent Application Kokai Nos. 62-162586 and 62-162587 disclose that sheet transferability on a printer and anti-blocking property are improved by providing a layer comprising a slight amount (0.01–1.0 g/m$^2$) of a powder on the side of a support opposite the recording layer side or on both sides.

An ink jet recording paper comprising a base paper of low sizing degree which is wetted with a coating composition for surface treatment is disclosed in Japanese Patent Application Kokai No. 52-53012. An another ink jet recording paper which is loaded with urea-formaldehyde resin powders as filler and is impregnated with a water-soluble polymer is disclosed in Japanese Patent Application Kokai No. 53-49113. Moreover, an ink jet recording paper comprising a support and an ink absorbing coating layer provided on the support is disclosed in Japanese Patent Application Kokai No. 55-5830, use of non-colloidal silica powders as pigments in the coating layer is disclosed in Japanese Patent Application Kokai Nos. 55-51583 and 56-157. Furthermore, a coated paper having two layers differing in ink absorbing rate is disclosed in Japanese Patent Application Kokai No. 55-11829.

Besides ink absorbing and anti-curling performances, fastness of recorded image is required. Recorded images are required to withstand wetting, and further demanded to resist discoloring upon exposure to light, ozone or oxidizing gases.

Use of cationic dye fixers for improving water resistance is disclosed, for example, in Japanese Patent Application Kokai Nos. 60-11389, 62-238783, 64-9776, 64-77572. Many proposals have been made for improving light resistance. In addition to these proposals, many further proposals from the side of recording sheet have been made in ink jet recording method and accordingly the quality of recorded images have also been highly improved.

It is required also that printed dot density be high, and printed image as a whole be sufficiently high, sharp, favorable in tinctorial characteristics, and colorants stay transparent to develop a clear and uniform color. In order to ensure these requirements, it is ideal that colorants of ink be fixed on the surface of the recording sheet and vehicle of the ink be absorbed underneath.

As for non-coated type ink jet recording sheet, the sheet has to absorb ink and for this purpose, a non-sized paper or a slightly sized paper containing a small amount of a sizing agent and/or a large amount of a filler is employed. While a sheet of this type exhibits a good ink absorption, color quality, sharpness and dots density as a whole tend to be poor. Moreover, it is likely that ragged fringe of a dot, so-called feathering, is prevailing, contour of a shape blurring, and the ink striking through.

On the other hand, the coated type ink jet recording sheet, a recording sheet comprising a non-sized or slightly-sized paper as a support and a coating layer provided thereon is superior in absorbing property and shows much improvement in color quality, sharpness, feathering, and strike-through as compared with the non-coated type ink jet recording sheet. Particularly, a recording sheet of this type having a coated layer containing amorphous silica particles and a water-soluble polymer shows excellent color quality, sharpness and resolution; feathering and strike-through are inhibited as well.

The coated layer certainly helps, particularly when a strongly sized paper, polyethylene terephthalate film, or synthetic paper that has little or no ink absorption capability by itself is made use of as a support. Fine particles like the amorphous silica particles having a size distribution characteristics that at least 90% of them fall within a volume mean range of 1–20 μm have a substantial void in them and the coated layer can absorb a substantial amount of ink, so that use of them helps inhibit bleeding, feathering and strike-through; moreover, their refractive index is small therefore scatters less light at the coated layer surface, so that use of such particles helps improve color quality. However, quality demand for the ink jet recording sheet, in terms of color quality, sharpness, feathering, runnability, etc., is growing ever stringent, and improvement of the coated layer alone can no longer meet such demand.

The object of the present invention is to provide a coated type ink jet recording sheet having such favorable characteristics that the resulting images are high in density, excellent in color quality and sharpness, that feathering of dots, strike-through and cockling are inhibited, and that image reproducibility is good.

The inventors have found that the above-mentioned characteristics of the recording sheet are improved when the gas permeability and the density of the sheet are regulated within a specific range.

That is, the first embodiment of the present invention is directed to an ink jet recording sheet which comprises a support mainly composed of a wood pulp and a filler and an ink-receiving layer provided on a side thereof, and has no backcoat layer on the other side, wherein the sheet has a P/D ratio of 25–200 where P is the gas permeability according to JIS P8117 and D is the density of the sheet according to JIS P8118.

The second embodiment of the present invention is directed to an ink jet recording sheet which comprises a support mainly composed of a wood pulp and a filler, an ink-receiving layer provided on a side thereof, and a backcoat layer provided on the other side thereof, wherein the sheet has a P/D ratio of 150–2000 where P is the gas permeability according to JIS P8117 and D is the density according to JIS P8118.

A method for producing the first embodiment according to the present invention comprises coating at least one ink-receiving layer by a known method on the surface of only a side of a support mainly composed of a wood pulp and a filler without coating backcoat layer on the other side of the support, wherein the sheet has a P/D in the range of 25–200 where P is the gas permeability according to JIS P8117 and D is the density according to JIS P8118.

A method for producing the second embodiment according to the present invention comprises coating a backcoat layer on the back side of a support mainly composed of a wood pulp and a filler and at least one ink-receiving layer on the surface side of the support by a known method, wherein the sheet has a P/D of 150–2000 where P is a gas permeability according to JIS P8117 and D is a density according to JIS P8118.

The inventors have found that when the recording sheet comprising a support mainly composed of a wood pulp and a filler and having at least one ink-receiving layer on one side and a backcoat layer on another side of the support (hereinafter referred to as "2CS sheet") and the recording sheet comprising said support having at least one ink-receiving layer on one side and no backcoat layer on another side of the support (hereinafter referred to as "1CS") are formed by regulating the above defined ratio of gas permeability/density (hereinafter referred to as "P/D ratio") within a specific range, there are obtained the characteristics of high image density, excellent color quality and sharpness of image, less-feathering, strike-through and cockling, and good image reproducibility.

The P/D ratio in the present invention is a parameter that reflects three-dimensional structure (void capillaries) formed by the support and coating layers such as ink-receiving layer and backcoat layer and especially the phenomenon of ink permeation in carrying out the recording with an aqueous ink is greatly influenced by this three-dimensional structure. A smaller P/D ratio indicates that the void formed by the support and the coating layer is larger; a greater P/D ratio indicates that the void smaller.

It has been found that when the P/D ratio is in the range of 150–2000 in the 2CS recording sheet, the ink jet recording sheet is obtained which can provide images of high density and excellent color quality and sharpness, is less in feathering, striking-through and cockling, and exhibits good image reproducibility. Thus, the present invention has been accomplished. When the P/D ratio is less than 150, large void or void capillaries having large bore are present, and the area of the inner void capillary wall is too small for ink which is considered to permeate along the void capillary wall and to be trapped there, and there occur striking-through of ink, non-uniform dot diameter and spread of ink dots. When the P/D ratio exceeds 2000, permeation of ink is hindered and ink absorption is poor resulting in smudging of the sheet while being transferred on a printer due to bleeding of the ink that failed being absorbed.

For the same reasons as in the 2CS sheet, in the case of the 1CS recording sheet, there can be also obtained an ink jet recording sheet having good image reproducibility by finishing the sheet regulating the P/D ratio within a specific range. That is, it has been found that when the P/D ratio is in the range of 25–200, the ink jet recording sheet is obtained which can provide images of high density and excellent color quality and sharpness, is less in feathering, striking-through and cockling and has good image reproducibility. Thus, the present invention has been accomplished.

Ink jet recording sheets are required to have such characteristics as high ink absorbing rate and large ink absorbing capacity, no occurrence of strike-through of ink, cockling and feathering, high image density, color quality and sharpness, and excellent image reproducibility. In the case of coated type ink jet recording sheets, vehicle of ink permeates the ink-receiving layer, the support and through the backcoat layer. Therefore, the support and the backcoat layer are also required to satisfy the above characteristics and preferably they also have a number of void capillaries. When a pigment is present in the support, since the vehicle of ink permeating through the ink-receiving layer is adsorbed to the surface of the pigment in the support or is absorbed into the voids formed by the wood pulp and the pigment, there can be obtained an ink jet recording sheet which has a large ink absorbing capacity, has good image reproducibility, namely, high image density and excellent color quality and sharpness, and is free from strike-through of ink and cockling. Especially when the content of the pigment is 10% by weight or more, preferably 20% by weight or more, the effects of the present invention are surely exhibited.

The ink-receiving layer comprises a pigment and a binder. Amount of the binder is preferably 5–60 parts by weight for 100 parts by weight of the pigment.

Both of the parameters P, gas permeability according to JIS P8117, and D, density according to JIS P8118, relate to amount of void capillaries in the recording sheet; the lower the value P, and the value D as well, mean the greater amount of the void capillaries. The values P and D go up generally when the support is applied with a coating layer and the coated web is calendered. Effect of calendering upon the values P and D for the coated layer(s) is less than same for the fibrous support. The values P and D are subjective to the coating composition and coating weight. Coating composition of the ink receiving layer, and of the backcoat layer as well as necessary, can be formulated properly and applied on the fibrous support containing a pigment, dried and surface-finished by a calender, wherein lineal pressure of the calender may be adjusted to bring said P/D ratio within said specific range.

As shown in an embodiment of the present invention, an ink receiving layer composition is formulated of a synthetic amorphous silica, polyvinyl alcohol, cationic dye fixing agent, and other additives. The coating composition is coated on a relatively high ash fibrous support containing 10% by weight of more (preferably 20% by weight or more) of a pigment at coating weight of 1–10 g/m$^2$ as dry solid, dried and surface-finished by a super calender where a lineal pressure of 50–200 kg/cm is applied to obtain an ink jet recording sheet whose P/D ratio falls within said specific range. While process conditions may vary from place to place, lineal pressure of a calender should be adjustable to bring the P/D ratio within the specific range. Whether or not to apply the backcoat layer is optional, but by applying a backcoat layer containing a polymer latex having a specific glass transition temperature range and a pigment having specific average equilibrium moisture content range strike-through, curling, blocking and other properties can be improved.

The coating weight of the ink-receiving layer is not specifically limited, but if it is too small, image density is low and color quality and sharpness of the image are inferior and feathering occurs though ink absorption property is good as in the case of non-coated type ink jet recording sheets. If the coating weight is too large, drying load in the drying step after coating or impregnation increases. As a result, not only the productivity decreases due to reduction in coating or impregnating speed, but also ink absorption rate at the surface of the coated layer decreases causing bleeding of ink dots. This is due to so-called binder migration; that is, the increased drying load means a high evaporation rate of the coating liquor in the drying step, and under that high evaporation rate the binder in the coating composition tends to migrate together with vapor to the surface of the ink-receiving layer to reduce voids of the surface. While the binder migration is influenced by concentration of the coating liquor and drying conditions, the coating weight is desirably 1– 10 g/m$^2$. A backcoat layer may be provided in the present invention. The coating weight of the backcoat layer is not specifically limited and is desirably determined depending on the coating or impregnating process or capacity of the drying step.

The support used in the present invention is mainly composed of a wood pulp and a filler. The wood pulp includes, for example, a chemical pulp such as LBKP or NBKP, a mechanical pulp such as GP, PGW, RMP, TMP, CTMP, CMP or CGP or a recycled fiber such as DIP. The support can be produced by mixing the wood pulp with a known filler and optionally at least one of the additives such as a binder, sizing agent, fixing agent, retention aid, cationizing agent and paper strengthening agent, and making papers from the resulting paper stock by various sheet formers such as Foudrinier machine, cylinder machine and twin-wire machine under acidic, neutral or alkaline paper making system. The ink-receiving layer may be provided on the resulting support as it is or after having been applied with a size press coat layer or an anchor coat layer of starch, polyvinyl alcohol or the like. If necessary, smoothness of the support may be controlled by a machine calender, super calender, soft calender or the like.

The support, the ink-receiving layer and the backcoat layer used in the present invention may contain at least one known white pigment. Examples of the white pigment are inorganic white pigments such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrated halloysite, magnesium carbonate, magnesium hydroxide and delaminated clay and organic pigments such as styrene plastics pigment, acrylic plastics pigment, polyethylene, microcapsules, urea resin and melamine resin. Among them, porous inorganic pigments are preferred as white pigments to be contained in the ink-receiving layer as a main component and include, for example, porous synthetic amorphous silica, porous magnesium carbonate and porous alumina and the porous synthetic amorphous silica having a large pore volume is especially preferred.

The pigment contained in the backcoat layer preferably has an average equilibrium moisture content M represented by the following formula (1) of 1.9–5.5% by weight in view of inhibiting curling.

$$M = \sum_{i=1}^{n} MiWi \tag{1}$$

wherein M denotes an average equilibrium moisture content (% by weight), i denotes a variable which shows the kind of pigment, n denotes the number of the kind of the pigment ($n \geqq 1$), Mi denotes an equilibrium moisture content of pigment i (% by weight), and Wi denotes a weight ratio of the pigment i to the total pigment ($0 < Wi \leqq 1$).

The equilibrium moisture content Mi is obtained by wet base water content defined by the following formula (2).

$$Mi = \{(Si - Di)/Si\} \times 100 \tag{2}$$

wherein Si denotes a mass of pigment i left to stand under 20° C. 65RH% for 24 hours and Di denotes a mass when the pigment is left to stand for 3 hours at 105° C. The measurement of equilibrium moisture content i is carried out by firstly obtaining Di of the pigment i and then obtaining Si.

Binders contained in the ink-receiving layer and the backcoat layer include, for example, polyvinyl alcohol, vinyl acetate, oxidized starch, etherified starch, cellulose derivatives such as carboxymethylcellulose and hydroxyethylcellulose, casein, gelatin, soybean protein, silyl-modified polyvinyl alcohol; conjugated diene copolymer latexes such as maleic anhydride resin, styrene-butadiene copolymer and methyl methacrylate-butadiene copolymer; acrylic polymer latexes such as polymers or copolymers of acrylate esters and methacrylate esters and polymers or copolymers of acrylic acid and methacrylic acid; vinyl polymer latexes such as ethylenevinyl acetate copolymer; functional group-modified polymer latexes obtained by modifying the above-mentioned various polymers with monomers containing functional group such as carboxyl group; aqueous adhesives such as thermosetting synthetic resins, for example, melamine resin and urea resin; synthetic resin adhesives such as polymethyl methacrylate, polyurethane resin, unsaturated polyester resin, vinyl chloride-vinyl acetate copolymer, polyvinyl butyral and alkyd resin. These may be used each alone or in combination of two or more.

As for the binders contained in the backcoat layer, when a synthetic polymer latex having a glass transition temperature (hereinafter referred to as "Tg") of −50° C. to +25° C. and at least one water-soluble binder selected from polyvinyl alcohol and cellulose derivatives are used in combination, curling properties of the ink jet recording sheet and pick-resistance are improved, and blocking is inhibited as well.

Total amount of the binders in the backcoat layer composition is preferably 5–60 parts by weight, more preferably 10–50 parts by weight per 100 parts by weight of the pigment. When the amount of the binder is less than 5 parts, pick-resistance goes down and when it is more than 60 parts by weight, curling properties become worse due to expansion or contraction of the binder.

As examples of the synthetic polymer latex, mention may be made of homopolymers and copolymers of vinyl acetate, styrene, ethylene, vinyl chloride, acrylic acid, isobutylene, chloroprene, butadiene, acrylonitrile, methyl methacrylate and acrylate esters, these polymers modified with carboxyl group, and combinations thereof.

In order for these polymer latexes to having Tg of −50° C. to +25° C., composition of the monomers should be properly adjusted, or two or more kinds of latexes are blended to bring Tg within that range. Furthermore, Tg can be adjusted by copolymerizing monomers with a film-forming aid or a plasticizer such as higher alkyl acrylate or fumaric acid.

Furthermore, as other additives to the respective layers, there may be added pigment dispersant, thickening agent, fluidity improver, antifoamer, foam inhibitor, releasing agent, foaming agent, penetrant, coloring dye, coloring pigment, fluorescent brightener, ultraviolet absorber, antioxidant, preservative, slimecide, water proofing agent, wet strengthening agent and dry strengthening agent.

For coating and impregnating the support with the ink-receiving layer or backcoat layer, there may be used a variety of coating means such as blade coater, roll coater, airknife coater, bar coater, rod blade coater, short dwell coater and size press in the manner of on- or off-machine. In employing any of these coating means, it is important to control permeation rate of coating solvent into the support.

When the support that absorbs water is coated or applied with a coating composition for the ink-receiving layer or backcoat layer, solvent, water or the like of the coating composition permeates into the support. The permeation readily takes place when solid concentration of the coating composition is low or its water retention property is low. If the solvent, water or the like of the coating composition permeates too quickly and selectively, solid concentration would increase making it difficult to control coating weight and, since the binder components permeate together, strength property of the ink-receiving layer and/or backcoat layer would decrease resulting in powdering of the coated layer(s). Too low solid concentration may lead not only to aforesaid selective permeation, but also to increased drying load, which in turn may cause migration of the binder to the surface of the coated layer to decrease bore of void capillaries in the coated layer. Non-uniform migration makes non-uniform distribution of composition components of the ink-receiving layer, and this may result in non-uniform size and shape of ink dots, thereby degrading image reproducibility.

Permeation of solvent, water or the like of the coating composition into the support takes place instantly as soon as they are brought into contact, therefore it is preferable to select an applicating and metering system that can restrict such permeation. In this regards, the system that applicates a pre-metered amount of the coating composition or allows the highest possible solid coating is preferred, and the effects of the present invention are further enhanced by using a roll coater, where the amount of the coating composition is metered prior to being coated, or a rod coater that allows a high solid coating. The coated web is then dried and may be surface-finished using calenders such as machine calender, TG calender, super calender and soft calender.

The aqueous ink referred to in the present invention is a recording solution comprising the following colorant, vehicle and other additives.

The colorants include water-soluble dyes such as direct dyes, acid dyes, basic dyes, reactive dyes and food dyes.

The vehicles for the aqueous ink include water and various water-soluble organic solvents, for example, alkyl alcohols of 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethyl formamide and dimethylacetamide; ketones or ketone alcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethylene glycol methyl ether, diethylene glycol methyl (or ethyl) ether and triethylene glycol monomethyl ether. Of these many water-soluble organic solvents, preferred are polyhydric alcohols such as diethylene glycol and lower alkyl ethers of polyhydric alcohols such as triethylene glycol monomethyl ether and triethylene glycol monoethyl ether. As the other additives, mention may be made of, for example, pH buffers, sequestering agents, slimecides, viscosity modifiers, surface tension modifiers, wetting agents, surface active agents and rust inhibitors.

The ink jet recording sheet of the present invention can be used not only as an ink jet recording sheet, but also as any sheets recordable by inks which are liquid at the time of recording. These recording sheets include, for example, a receiving sheet for heat transfer recording, where a donor sheet comprising a thin support such as a resin film and a heat-meltable ink layer provided thereon mainly composed of a heat-meltable wax and colorants is heated from the back side to fuse the ink layer and let it transfer; a specific ink jet recording sheet where a solid but heat-fusible ink is molten and jetted onto it to carry out recording, and another specific ink jet recording sheet where an ink solution is oleophilic one containing an oil-soluble dye therein; and a receiving sheet to be used with a photo/pressure-sensitive donor sheet coated with microcapsules containing a photopolymerizable monomer and colorless or colored dye or pigment.

These recording sheets are common in that the ink used is in a liquid state at recording. A liquid ink permeates or diffuses vertically and horizontally into the ink-receiving layer until it ink is hardened, solidified or fixed. The above-mentioned various recording sheets require the ink absorbency in conformity with the respective recording methods and the ink jet recording sheet of the present invention can be utilized as the above-mentioned various recording sheets.

The ink jet recording sheet of the present invention can be used as the recording sheets for electrophotographic recording on which a toner is fixed by heating and which are widely used in copying machines, printers and the like.

According to the present invention, a coated type ink jet recording sheet comprising a support mainly composed of a wood pulp and a pigment and at least one ink-receiving layer provided on the support which can provide images of high density, excellent color quality and sharpness and less feathering, is less in strike-through of ink and cockling and thus has good image reproducibility can be obtained by regulating the P/D ratio within a specific range in which P is a gas permeability P according to JIS P8117 and D is a density according to JIS P8118. That is, since the ink jet recording involves permeation phenomenon in forming an image, the permeation of the ink must be controlled. By employing the P/D ratio as an indicator as in the present invention, images of high density and excellent color quality and sharpness can be obtained and furthermore, strike-through of ink and cockling can be reduced.

The following examples are illustrative of the present invention and are not intended for purposes of limitation. All parts and % are by weight unless otherwise notified.

1) Ash content of the support:

Absolute dry weight $W_0$ of the support was measured and this support was put in a crucible and burnt at 550° C. Weight W of the residue in the crucible was measured and ash content F (%) was calculated by the following formula (3).

$$F(\%)=(W/W_0)\times 100 \quad (3)$$

2) Density and gas permeability:

The density and the gas permeability were measured in accordance with JIS P8118 and JIS P8117, respectively.

Furthermore, ink jet recording performances were measured by the following methods under the conditions according to JIS P8111.

3) Image density:

The printed image density was evaluated by measuring optical density of monochromatic solid images formed by printing with each of black, yellow, magenta and cyan inks using an ink jet printer IO-720 manufactured by Sharp Corporation. The higher value indicates the higher and the better density. For example, in the case of black, a value of 1.30 or higher shows that the density is sufficiently good.

4) Diameter of printed dot:

Three kinds of ink dots, monochromatic cyan, monochromatic magenta, and overlapping cyan and magenta, were printed on a specimen sheet using an ink jet printer IO-720 manufactured by Sharp Corporation. Then, diameter of the dot as circle (HD) was calculated by the following formula (4) based on the dot area (A) determined by an image analyzer.

$$HD=\{(4/\pi)\times A\}^{1/2} \quad (4)$$

In the above formula, HD denotes the diameter of the dot as a circle (Heywood Diameter: μm) and A denotes the area ($\mu m^2$).

5) Degree of overlapping ink dots spread:

Monochromatic magenta ink dots and overlapping dots using two monochromatic inks, magenta and cyan, are put on a specimen sheet. The ratio of the dot diameter of the overlapping ink dot (magenta+cyan) to the monochromatic magenta ink dot was evaluated. The smaller the ratio, the smaller the difference between the diameter of the two monochromatic dots, meaning that the color quality of the resulting image is superior. A ratio of 1–1.2 shows that the image is good, but when this exceeds 1.2, the image appears inferior.

6) Ink absorbing rate:

An area of red solid image (by overlapping magenta and yellow ink dots) was printed on a specimen sheet using an ink jet printer IO-720 manufactured by Sharp Corporation. Right after the initiation of the printing (approx. 1 second), the sheet was forcibly ejected allowing that red solid image contact a paper cramp roller or paper guide of the printer and whether the sheet leaves stain on those parts or not was observed. When no staining is observable, the ink absorbing rate is high meaning a good ink jet recording sheet.

7) Cockling and degree of undulation as reflected to stain of recorded image due to touching with print head:

An area of blue solid image (by overlapping cyan and magenta) was printed on a specimen sheet using an ink jet printer IO-720 manufactured by Sharp Corporation and state of cockling was visually inspected. In the following criteria, the ink jet recording sheets of A and B are acceptable. Furthermore, stain caused by touching of projections with the print head during printing was visually evaluated. The results were graded by the following criteria and are shown in Tables 3 and 4.

Criteria for the cockling:

A: Substantially no cockling of sheet observable (good).

B: Some cockling observable (practically acceptable).

C: Considerable cockling observable (practically unacceptable).

Criteria for the stain:

A: No staining observable (good).

B: Some staining observable (practically acceptable).

C: Considerable staining observable (practically unacceptable).

8) Strike-through:

An area of blue solid image (by overlapping cyan and magenta) was printed on a specimen sheet using an ink jet printer IO-720 manufactured by Sharp Corporation, and optical density of magenta color on the back was measured. When the optical density is 0.25 or less, there is substantially no problem in practical use, but the value exceeding 0.25a indicates that considerable strike-through has taken place and that the sheet is not suitable for practical use.

9) Curl:

The specimen sheets (A4 size) obtained in the following Examples and Comparative Examples were allowed to stand under each of the conditions: 5° C. 10%RH, 20° C. 65%RH and 40° C. 90%RH for 24 hours. Thereafter, the samples were placed on a flat table, and the resulting curl in terms of heights (H) at the four corners of the sheet were measured; the sheet was placed with each of the curled corner tips up and its height from the table was measured. The results were graded by the following criteria.

| | | |
|---|---|---|
| A: $0 \leqq H < 5$ | (mm): | Good |
| B: $5 \leqq H \leqq 10$ | (mm): | Practically acceptable. |
| C: $10 < H$ | (mm): | Transferability of the sheet greatly deteriorates and this is practically unacceptable. |

10) Pick-resistance:

A commercially available adhesive tape was pasted to the surface of the backcoat layer and peeled off. Degree of picking by the adhesive tape was visually inspected and graded by the following criteria. The grades A and B indicate that there are practically no problems.

A: No picking by the tape was observable; good pick-resistance.

B: Some trace of picking observable; practically acceptable.

C: Appreciable picking observable: practically unacceptable.

11) Blocking:

Ten A4 size specimen sheets were superposed into a stack, a 3 kg weight was put thereon, and the stack with the weight on top was left to stand for 24 hours under the conditions of 40° 90%RH. Thereafter, degree of blocking of the sheets in stack was visually inspected and graded by the following criteria. The grades A and B mean that the sample has no problem in quality in this regards.

A: No blocking observable.

B: Slight blocking observable, but there is practically no problem in transferability of the sheet.

C: Considerably blocking and coated layer(s) peeled off partially when the stack was separated into sheets. This is practically unacceptable.

12) Relative change in height of curl:

The specimen sheets (A4 size) obtained in the following Examples and Comparative Examples were allowed to stand under each of the three conditions: 5° C. 10%RH, 20° C. 65%RH and 40° C. 90%RH for 24 hours. Thereafter, the sheets were placed on a flat table and heights (H) of curls at the four corners of the sheet were measured. The relative change in height of curl is a difference between the height of the curl after having undergone the 20° C. 65%RH condition as a control ($H_M$) and same after having undergone the other conditions. The relative change in height of curl after having undergone the 5° C. 10%RH and 40° C. 90%RH condition is referred to as $H_L$ and $H_H$ respectively, to which plus (+) and minus (–) is suffixed depending on the curl directions, towards the ink-receiving layer side and towards the backcoat layer side, respectively. If each of the measures, $H_L$, $H_H$ and $H_L$–$H_H$, fails to fall within ±10 (mm), the specimen sheet under this test is determined unsuccessful.

EXAMPLE 1

A support was produced by mixing a wood pulp comprising 80 parts of LBKP (freeness: 400 ml csf) and 20 parts of NBKP (freeness: 480 ml csf) with 30 parts of pigments comprising precipitated calcium carbonate/ground calcium carbonate/talc (30/35/35), 0.08 part of commercially available alkyl ketene dimer and 0.03 part of commercially available cationic acrylamide having a molecular weight of 5,000,000 and making the mixture into a paper of 78 g/m$^2$ in basis weight and 17.6% in ash content by a Fourdrinier paper machine.

An ink-receiving layer was provided on the surface of the thus obtained support. That is, a coating composition for ink-receiving layer comprising 100 parts of a synthetic amorphous silica (FINESIL X37B manufactured by Tokuyama Soda Co., Ltd.) and 60 parts of polyvinyl alcohol (PVA 117 manufactured by Kuraray Co., Ltd.) was prepared. The resulting coating composition of 13% in solid concentration was coated on the surface of the support at a coating weight of 2 g/m$^2$ by an airknife coater and dried. Then, the thus coated support was subjected to calendering under a linear pressure of 50 kg/cm to obtain an ink jet recording sheet.

EXAMPLE 2

On a support produced in the same manner as in Example 1 was coated the same ink-receiving layer as in Example 1 except that the coating weight was 6 g/m$^2$ and the solid concentration was 15%. A coating composition for backcoat layer comprising 100 parts of kaolin (Hydrasperse manufactured by Huber Co.), 5 parts of silyl-modified polyvinyl alcohol (R Polymer 1130 manufactured by Kuraray Co., Ltd.) and 15 parts of a styrene butadiene latex (0617 manufactured by Japan Synthetic Rubber Co., Ltd.) and having a solid concentration of 35% was prepared and coated at a coating weight of 4 g/m$^2$ on another side of the above support by an airknife coater. After drying, the coated support was subjected to calendering under a linear pressure of 100 kg/cm to obtain an ink jet recording sheet.

EXAMPLE 3

On a support produced in the same manner as in Example 1 were coated an ink-receiving layer and a backcoat layer with the same composition and in the same manner as in Example 2 except that coating weight of the ink-receiving layer was 10 g/m$^2$ and that of the backcoat layer was 8 g/m$^2$. After drying, the coated support was subjected to calendering under a linear pressure of 200 kg/cm to obtain an ink jet recording sheet.

EXAMPLE 4

A support was produced by mixing a wood pulp comprising 80 parts of LBKP (freeness: 400 ml csf) and 20 parts of NBKP (freeness: 480 ml csf) with 40 parts of pigments comprising precipitated calcium carbonate/ground calcium carbonate/talc (30/35/35), 0.10 part of commercially available alkyl ketene dimer, 0.03 part of commercially available cationic acrylamide having a molecular weight of 7,000,000, 1.0 part of commercially available cationized starch and 0.05 part of aluminum sulfate and making the mixture into a paper of 90 g/m$^2$ in basis weight and 28.1% in ash content by a Fourdrinier paper machine. On this support were coated an ink-receiving layer with the same composition and in the same manner as in Example 1 and a backcoat layer with the same composition and in the same manner as in Example 2. After drying, the coated support was subjected to calendering treatment under the same linear pressure of 200 kg/cm as in Example 3 to obtain an ink jet recording sheet.

EXAMPLE 5

On a support obtained in the same manner as in Example 4 were coated an ink-receiving layer with the same composition and in the same manner as in Example 2 and a backcoat layer with the same composition and in the same manner as in Example 3. After drying, the coated support was subjected to calendering under the same linear pressure of 50 kg/cm as in Example 1 to obtain an ink jet recording sheet.

EXAMPLE 6

On a support obtained in the same manner as in Example 4 was coated an ink-receiving layer with the same composition and in the same manner as in Example 3. A backcoat layer was not provided. After drying, the coated support was subjected to calendering under the same linear pressure of 100 kg/cm as in Example 2 to obtain an ink jet recording sheet.

EXAMPLE 7

A support was produced by mixing a wood pulp comprising 80 parts of LBKP (freeness: 400 ml csf) and 20 parts of NBKP (freeness: 480 ml csf) with 20 parts of pigments comprising precipitated calcium carbonate/ground calcium carbonate/talc (30/35/35), 0.05 part of commercially available alkyl ketene dimer and 0.03 part of commercially available cationic acrylamide having a molecular weight of 5,000,000 and making the mixture into a paper of 105 g/m$^2$ in basis weight and 10.5% in ash content by a Fourdrinier paper machine. On this support were coated an ink-receiving layer with the same composition and in the same manner as in Example 1 and a backcoat layer with the same composition and in the same manner as in Example 3. After drying, the coated support was subjected to calendering treatment under the same linear pressure of 100 kg/cm as in Example 2 to obtain an ink jet recording sheet.

EXAMPLE 8

On a support obtained in the same manner as in Example 7 was coated an ink-receiving layer with the same composition and in the same manner as in Example 2. A backcoat layer was not provided. After drying, the coated support was subjected to calendering under the same linear pressure of 200 kg/cm as in Example 3 to obtain an ink jet recording sheet.

EXAMPLE 9

On a support obtained in the same manner as in Example 7 were coated an ink-receiving layer with the same composition and in the same manner as in Example 3 and a backcoat layer with the same composition and in the same manner as in Example 2. After drying, the coated support was subjected to calendering under the same linear pressure of 50 kg/cm as in Example 1 to obtain an ink jet recording sheet.

EXAMPLE 10

On a support obtained in the same manner as in Example 1 was coated an ink-receiving layer with the same composition and in the same manner as in Example 1 except that the solid concentration was 15% and the coating weight was 6 g/m$^2$ and a roll coater was employed. A backcoat layer was coated with the same composition and in the same manner as in Example 2. After drying, the coated support was subjected to calendering under the same linear pressure of 100 kg/cm as in Example 2 to obtain an ink jet recording sheet.

EXAMPLE 11

On a support obtained in the same manner as in Example 1 was coated an ink-receiving layer with the same composition and in the same manner as in Example 1 except that the solid concentration was 16% and the coating weight was 6 g/m$^2$ and a rod coater was employed. A backcoat layer was coated with the same composition and in the same manner as in Example 2. After drying, the coated support was subjected to calendering under the same linear pressure of 100 kg/cm as in Example 2 to obtain an ink jet recording sheet.

EXAMPLE 12

On a support obtained in the same manner as in Example 1 was coated an ink-receiving layer with the same composition and in the same manner as in Example 1 except that the solid concentration was 15% and the coating weight was 2 g/m$^2$ and a roll coater was employed. A backcoat layer was not provided. After drying, the coated support was subjected to calendering under the same linear pressure of 50 kg/cm as in Example 1 to obtain an ink jet recording sheet.

EXAMPLE 13

On a support obtained in the same manner as in Example 1 was coated an ink-receiving layer with the same composition and in the same manner as in Example 1 except that the solid concentration was 16% and the coating weight was 2 g/m$^2$ and a rod coater was employed. A backcoat layer was not provided. After drying, the coated support was subjected to calendering under the same linear pressure of 50 kg/cm as in Example 1 to obtain an ink jet recording sheet.

COMPARATIVE EXAMPLE 1

An ink jet recording sheet comprising a support and an ink-receiving layer was produced in the same manner as in Example 1 except that the coated support was not subjected to calendering.

COMPARATIVE EXAMPLE 2

An ink jet recording sheet comprising a support and an ink-receiving layer was produced in the same manner as in Example 2 except that the coated support was not subjected to calendering.

COMPARATIVE EXAMPLE 3

An ink jet recording sheet comprising a support, an ink-receiving layer and a backcoat layer was produced in the same manner as in Example 3 except that the coated support was subjected to calendering under a linear pressure of 300 kg/cm.

COMPARATIVE EXAMPLE 4

An ink jet recording sheet comprising a support, an ink-receiving layer and a backcoat layer was produced in the same manner as in Example 5 except that the coated support as subjected to calendering under a linear pressure of 200 kg/cm.

Constructions of the samples having no backcoat layer and results of the evaluation of these samples are shown in Table 1 and constructions of the samples having backcoat layer and results of the evaluation of these samples are shown in Table 2.

TABLE 1

| | | Example 1 | Example 6 | Example 8 | Example 12 | Example 13 | Comparative Example 1 |
|---|---|---|---|---|---|---|---|
| [Support] | | | | | | | |
| LBKP | (part) | 80 | 80 | 80 | 80 | | |
| NBKP | (part) | 20 | 20 | 20 | 20 | | |
| Pigment | (part) | 30 | 40 | 20 | 30 | | |
| Precipitated calcium carbonate | (part) | 9 | 12 | 6 | 9 | | |
| Ground calcium carbonate | (part) | 10.5 | 14 | 7 | 10.5 | | |
| Talc | (part) | 10.5 | 14 | 7 | 10.5 | | |
| Alkyl ketene dimer | (part) | 0.08 | 0.10 | 0.05 | 0.08 | | |
| Cationic acrylamide | (part) | 0.03 | 0.03 | 0.03 | 0.03 | | |
| Cationized starch | (part) | — | 1.0 | — | — | | |
| Aluminum sulfate | (part) | — | 0.05 | — | — | | |
| Basis weight | ($g/m^2$) | 78 | 90 | 105 | 78 | | |
| Ash content | (%) | 17.6 | 18.1 | 10.5 | 17.6 | | |
| [Ink-receiving layer] | | | | | | | |
| Synthetic amorphous silica | (part) | 100 | | | | | |
| PVA 117 | (part) | 60 | | | | | |
| Solid concentration | (%) | 13 | 15 | 15 | 15 | 16 | 13 |
| Coating weight | ($g/m^2$) | 2 | 10 | 6 | 2 | 2 | 2 |
| Coating method | | | Airknife | | Roll | Rod | Airknife |
| Calendering linear pressure | (kg/cm) | 50 | 100 | 200 | 50 | 50 | — |
| Gas permeability P | (sec) | 34 | 172 | 177 | 54 | 45 | 18 |
| Density D | ($g/cm^3$) | 1.04 | 1.00 | 1.09 | 1.04 | 1.03 | 0.84 |
| P/D ratio | | 33 | 172 | 162 | 52 | 44 | 21 |
| Diameter of dot (μm) | Cyan | 368 | 312 | 351 | 357 | 359 | 363 |
| Diameter of dot (μm) | Magenta | 364 | 330 | 383 | 361 | 356 | 357 |
| Diameter of dot (μm) | Cyan + Magenta | 429 | 361 | 397 | 412 | 409 | 433 |
| Degree of overlapping ink dot spread | | 1.18 | 1.09 | 1.04 | 1.14 | 1.15 | 1.41 |
| Cockling | | A | A | A | A | A | B |
| Stain due to contact with head | | A | A | A | A | A | A |
| Strike-through | | 0.24 | 0.20 | 0.24 | 0.22 | 0.22 | 0.29 |

TABLE 2

| | | Example 2 | Example 3 | Example 4 | Example 5 | Example 7 | Example 9 | Example 10 | Example 11 | Comparative Example 2 | Comparative Example 3 | Comparative Example 4 |
|---|---|---|---|---|---|---|---|---|---|---|---|---|
| [Support] | | | | | | | | | | | | |
| LBKP | (part) | 80 | | 80 | | 80 | | 80 | | | | 80 |
| NBKP | (part) | 20 | | 20 | | 20 | | 20 | | | | 20 |
| Pigment | (part) | 30 | | 40 | | 20 | | 30 | | | | 40 |
| Precipitated calcium carbonate | (part) | 9 | | 12 | | 6 | | 9 | | | | 12 |
| Heavy calcium carbonate | (part) | 10.5 | | 14 | | 7 | | 10.5 | | | | 14 |
| Talc | (part) | 10.5 | | 14 | | 7 | | 10.5 | | | | 14 |
| Alkyl ketene dimer | (part) | 0.08 | | 0.10 | | 0.05 | | 0.08 | | | | 0.10 |
| Cationic acrylamide | (part) | 0.03 | | 0.03 | | 0.03 | | 0.03 | | | | 0.03 |
| Cationized starch | (part) | — | | 1.0 | | — | | — | | | | 1.0 |
| Aluminum sulfate | (part) | — | | 0.05 | | — | | — | | | | 0.05 |
| Basis weight | ($g/m^2$) | 78 | | 90 | | 105 | | 78 | | | | 90 |
| Ash content | (%) | 17.6 | | 28.1 | | 10.5 | | 17.6 | | | | 28.1 |
| [Ink-receiving layer] | | | | | | | | | | | | |
| Synthetic amorphous silica | (part) | 100 | | | | | | | | | | |
| PVA 117 | (part) | 60 | | | | | | | | | | |
| Solid concentration | (%) | 15 | 15 | 13 | 15 | 13 | 15 | 15 | 16 | 15 | 15 | 15 |
| Coating weight | ($g/m^2$) | 6 | 10 | 2 | 6 | 2 | 10 | 6 | 6 | 6 | 10 | 6 |
| Coating method | | | | Airknife | | | | Roll | Rod | | Airknife | |
| [Backcoat layer] | | | | | | | | | | | | |
| Kaolin | (part) | 100 | | | | | | | | | | |
| Average equilibrium moisture content of pigment | (%) | 1.2 | | | | | | | | | | |
| Silyl-modified PVA | (part) | 5 | | | | | | | | | | |
| SBR latex 0617 | (part) | 15 | | | | | | | | | | |

TABLE 2-continued

| | | Example 2 | Example 3 | Example 4 | Example 5 | Example 7 | Example 9 | Example 10 | Example 11 | Comparative Example 2 | Comparative Example 3 | Comparative Example 4 |
|---|---|---|---|---|---|---|---|---|---|---|---|---|
| Tg of latex | (°C.) | +5°C. | | | | | | | | | | |
| Solid concentration | (%) | 35 | | | | | | | | | | |
| Coating weight | (g/m$^2$) | 4 | 8 | 4 | 8 | 8 | 4 | 4 | 4 | 4 | 8 | 8 |
| Calendaring linear pressure | (kg/cm) | 100 | 200 | 200 | 50 | 100 | 50 | 100 | 100 | — | 300 | 200 |
| Gas permeability P | (sec) | 241 | 1965 | 645 | 1608 | 954 | 292 | 280 | 263 | 93 | 2785 | 3386 |
| Density D | (g/cm$^3$) | 1.06 | 1.09 | 1.15 | 1.06 | 1.13 | 1.01 | 1.05 | 1.06 | 0.90 | 1.12 | 1.14 |
| P/D ratio | | 227 | 1803 | 561 | 1517 | 844 | 289 | 267 | 248 | 103 | 2487 | 2970 |
| Diameter of dot (μm) | Cyan | 339 | 332 | 373 | 334 | 375 | 319 | 327 | 336 | 329 | 342 | 347 |
| Diameter of dot (μm) | Magenta | 367 | 342 | 390 | 343 | 373 | 321 | 346 | 340 | 350 | 337 | 370 |
| Diameter of dot (μm) | Cyan + Magenta | 406 | 354 | 410 | 394 | 425 | 367 | 370 | 375 | 486 | 367 | 403 |
| Degree of overlapping ink dot spread | | 1.11 | 1.04 | 1.05 | 1.15 | 1.14 | 1.14 | 1.07 | 1.10 | 1.38 | 1.03 | 1.09 |
| Cockling | | A | A | A | A | A | A | A | A | B | C | C |
| Stain due to contact with head | | A | A | A | A | A | A | A | A | A | C | C |
| Strike-through | | 0.17 | 0.15 | 0.20 | 0.14 | 0.16 | 0.15 | 0.14 | 0.15 | 0.19 | 0.17 | 0.15 |

As for the printed image density, there are differences relating to the coating weight of the ink-receiving layer and the kind of the support, but all of the samples gave good printed image density. As is clear from Example 2 and Comparative Example 2, in the case of the 2CS ink jet recording sheet of the present invention, when the P/D ratio is small, degree of overlapping ink dots spread becomes large, and this may degrade in color quality, sharpness and image reproducibility. Thus, the desired ink jet recording sheet cannot be obtained. Furthermore, in Comparative Example 2, occurrence of cockling which is attributable to excessive permeation and diffusion of ink in the sheet is noticeable. Moreover, as can be seen from Comparative Examples 3 and 4, when the P/D ratio is large, the degree of overlapping ink dots spread is small, but cockling and degree of undulation as reflected to stain of head are unfavourable. This is due to non-uniform permeation and diffusion of ink in the sheet, and especially the stain is detrimental for the formation of image. Furthermore, in Examples 2–5, 7 and 9 in which the P/D ratio is in the range of 150–2000, as can be seen from the degree of ink dot spread, there are obtained ink jet recording sheets which exhibit favorable ink dots spread, feathering, strike-through and cockling leading to superior image reproducibility.

It is clear from Example 1 and Comparative Example 1 and Examples 6 and 8 that the 1CS ink jet recording sheets of the present invention have the superior effects similar to those of the 2CS recording sheets. It can be seen that when the P/D ratio is in the range of 25–200, there are obtained 1CS ink jet recording sheets which exhibit favorable ink dots spread, feathering, strike-through and cockling leading to superior image reproducibility.

Furthermore, as can be seen from Example 2 and Examples 10 and 11 relating to 2CS sheets and Example 1 and Examples 12 and 13 relating to 1CS sheets, the said favorable characteristics are further enhanced by employing a roll coater or a rod coater as a coating system in providing the ink-receiving layer.

According to the present invention, by forming an ink jet recording sheet by regulating the ratio of gas permeability/density, there can be obtained a coated type ink jet recording sheet which can render images high in density, excellent in color quality and sharpness, less in feathering, strike-through and cockling, and hence superior in image reproducibility.

COMPARATIVE EXAMPLE 5

A support was obtained in the same manner as in Example 4.

40 parts of colloidal silica (Snowtex-O manufactured by Nissan Chemical Industries, Ltd.), 100 parts of synthetic amorphous silica (FINESIL X37B manufactured by Tokuyama Soda Co., Ltd.), 40 parts of polyvinyl alcohol (PVA 117 manufactured by Kuraray Co., Ltd.), 10 parts of polyvinyl alcohol (PVA 105 manufactured by Kuraray Co., Ltd.), 3 parts of a stilbene fluorescent dye and 30 parts of a cationic dye fixer (Sumirez Resin 1001 manufactured by Sumitomo Chemical Co., Ltd.) were mixed to prepare a coating composition for ink-receiving layer having a solid concentration of 15%. This coating composition was coated on one side of the support at a coating weight of 8 g/m$^2$ by an airknife coater to provide an ink-receiving layer.

Furthermore, 75 parts of hydrated halloysite (KA Press manufactured by Oharu Kagaku Kogyosho Co.; equilibrium moisture content: 4.9%), 15 parts of a delaminated clay (Nuclay manufactured by Engelhard Co.; equilibrium moisture content: 1.2%), 10 parts of ground calcium carbonate (Softon 2200 manufactured by Bihoku Funka Kogyo Co.; equilibrium moisture content: 0.3%) [average equilibrium moisture content of these three pigments: 3.9%], 0.4 part of sodium polyacrylate (pigment dispersant), 5 parts of a silyl-modified polyvinyl alcohol (R Polymer 1130 manufactured by Kuraray Co., Ltd.) and 10 parts of a styrene-butadiene latex (Tg: −60° C.) were mixed to prepare a coating composition for backcoat layer having a solid concentration of 35%. This coating composition was coated on another side of the support at a coating weight of 10 g/m$^2$ by an airknife coater. The coated support was subjected to calendering under a linear pressure of 100 kg/cm to obtain an ink jet recording sheet.

EXAMPLES 14–18 AND COMPARATIVE EXAMPLE 6

The procedure of Comparative Example 5 was repeated except that a backcoat layer was provided using the styrene-butadiene latex having a Tg as shown in Table 3, thereby to obtain ink jet recording sheets.

EXAMPLE 19

The procedure of Example 16 was repeated except that 5 parts of oxidized starch was used in place of 5 parts of the silyl-modified polyvinyl alcohol, thereby to obtain an ink jet recording sheet.

EXAMPLE 20

The procedure of Example 16 was repeated except that 5 parts of polyvinyl alcohol (PVA 117 manufactured by Kuraray Co., Ltd.) and 1 part of carboxymethylcellulose were used in place of 5 parts of the silyl-modified polyvinyl alcohol, thereby to obtain an ink jet recording sheet.

Construction of each sample and results of the evaluation are shown in Table 3.

TABLE 3

| | | Comparative Example 5 | Example 14 | Example 15 | Example 16 | Example 17 | Example 18 | Example 19 | Example 20 | Example 21 |
|---|---|---|---|---|---|---|---|---|---|---|
| [Support] | | | | | | | | | | |
| LBKP | (part) | 80 | | | | | | | | |
| NBKP | (part) | 20 | | | | | | | | |
| Pigment | (part) | 40 | | | | | | | | |
| Precipitated calcium carbonate | (part) | 12 | | | | | | | | |
| Heavy calcium carbonate | (part) | 14 | | | | | | | | |
| Talc | (part) | 14 | | | | | | | | |
| Alkyl ketene dimer | (part) | 0.10 | | | | | | | | |
| Cationic acrylamide | (part) | 0.03 | | | | | | | | |
| Cationized starch | (part) | 1.0 | | | | | | | | |
| Aluminum sulfate | (part) | 0.05 | | | | | | | | |
| Basis weight | ($g/m^2$) | 90 | | | | | | | | |
| Ash content | (%) | 28.1 | | | | | | | | |
| [Ink-receiving layer] | | | | | | | | | | |
| Colloidal silica | (part) | 40 | | | | | | | | |
| Synthetic amorphous silica | (part) | 100 | | | | | | | | |
| PVA 117 | (part) | 40 | | | | | | | | |
| PVA 105 | (part) | 10 | | | | | | | | |
| Fluorescent dye | (part) | 3 | | | | | | | | |
| Cationic dye fixer | (part) | 30 | | | | | | | | |
| Solid concentration | (%) | 15 | | | | | | | | |
| Coating amount | ($g/m^2$) | 8 | | | | | | | | |
| Coating method | | Airknife | | | | | | | | |
| [Backcoat layer] | | | | | | | | | | |
| Hydrated halloysite | (part) | 75 | | | | | | | | |
| Delaminated clay | (part) | 15 | | | | | | | | |
| Ground calcium carbonate | (part) | 10 | | | | | | | | |
| Average equilibrium water content of pigment | (%) | 3.9 | | | | | | | | |
| Sodium polyaclrylate | (part) | 0.4 | | | | | | | | |
| Silyl-modified PVA | (part) | 5 | | | | | | | — | |
| Oxidized starch | (part) | — | | | | | | | 5 | — |
| Polyvinyl alcohol | (part) | — | | | | | | | | 5 |
| Carboxy-methylcellulose | (part) | — | | | | | | | | 1 |
| Styrene.butadiene latex | (part) | 10 | | | | | | | | |
| Tg of latex | (°C.) | −60 | −50 | −40 | +5 | +20 | +25 | +40 | +5 | +5 |
| Solid concentration | (%) | 35 | | | | | | | | |
| Coating weight | ($g/m^2$) | 10 | | | | | | | | |
| Calendaring linear pressure | (kg/cm) | 100 | | | | | | | | |
| Gas permeability P | (sec) | 2918 | 1985 | 1747 | 1253 | 958 | 892 | 780 | 1086 | 1429 |
| Density D | ($g/cm^3$) | 1.14 | 1.14 | 1.13 | 1.11 | 1.09 | 1.09 | 1.08 | 1.11 | 1.11 |
| P/D ratio | | 2560 | 1741 | 1546 | 1129 | 879 | 818 | 661 | 978 | 1287 |
| Diameter of dot (μm) | Cyan | 331 | 332 | 335 | 344 | 352 | 352 | 353 | 345 | 342 |
| Diameter of dot (μm) | Magenta | 345 | 342 | 345 | 351 | 360 | 365 | 365 | 349 | 352 |
| Diameter of dot (μm) | Cyan + Magenta | 451 | 398 | 391 | 388 | 377 | 378 | 375 | 375 | 392 |
| Degree of overlapping ink dot spread | | 1.31 | 1.16 | 1.13 | 1.11 | 1.05 | 1.04 | 1.03 | 1.07 | 1.11 |
| Cockling | | C | B | A | A | A | A | A | A | A |
| Stain due to | | C | A | A | A | A | A | A | A | A |

TABLE 3-continued

| | Comparative Example 5 | Example 14 | Example 15 | Example 16 | Example 17 | Example 18 | Example 19 | Example 20 | Example 21 |
|---|---|---|---|---|---|---|---|---|---|
| contact with head | | | | | | | | | |
| Strike-through | 0.25 | 0.18 | 0.16 | 0.14 | 0.14 | 0.13 | 0.14 | 0.15 | 0.14 |
| Curl 5° C., 10% RH | C | B | A | A | A | A | A | B | A |
| Pick-resistance | A | A | A | A | A | A | C | B | A |
| Blocking | C | B | A | A | A | A | A | A | A |

As can be seen from Table 3, when Tg of the latex in the backcoat layer is in the range of −50° C. to +25° C., curling properties and pick-resistance are improved, and blocking is effectively inhibited.

EXAMPLES 16, 21–24, AND COMPARATIVE EXAMPLES 3, 7 and 8

On one side of the supports obtained in the same manner as in Comparative Example 5 was provided the ink-receiving layer in the same manner as in Comparative Example 5.

The pigments, sodium polyacrylate, silyl-modified polyvinyl alcohol and SBR latex as shown in Table 4 were mixed to prepare coating compositions for the backcoat layer having a solid concentration of 35%. The resulting coating composition was coated on another side of the supports at a coating weight of 10 g/m$^2$ and the coated supports were subjected to calendering under a linear pressure of 100 kg/cm to obtain ink jet recording sheets.

Construction of each sample and results of evaluation are shown in Table 4.

TABLE 4

| | | Example 22 | Example 23 | Example 24 | Example 25 | Example 26 | Example 27 | Example 28 |
|---|---|---|---|---|---|---|---|---|
| [Support] | | | | | | | | |
| LBKP | (part) | 80 | | | | | | |
| NBKP | (part) | 20 | | | | | | |
| Pigment | (part) | 40 | | | | | | |
| Precipitated calcium carbonate | (part) | 12 | | | | | | |
| Ground calcium carbonate | (part) | 14 | | | | | | |
| Talc | (part) | 14 | | | | | | |
| Alkyl ketene dimer | (part) | 0.10 | | | | | | |
| Cationic acrylamide | (part) | 0.03 | | | | | | |
| Cationized starch | (part) | 1.0 | | | | | | |
| Aluminum sulfate | (part) | 0.05 | | | | | | |
| Basis weight | (g/m$^2$) | 90 | | | | | | |
| Ash content | (%) | 28.1 | | | | | | |
| [Ink-receiving layer] | | | | | | | | |
| Colloidal silica | (part) | 40 | | | | | | |
| Synthetic amorphous silica | (part) | 100 | | | | | | |
| PVA 117 | (part) | 40 | | | | | | |
| PVA 105 | (part) | 10 | | | | | | |
| Fluorescent dye | (part) | 3 | | | | | | |
| Cationic dye fixer | (part) | 30 | | | | | | |
| Solid concentration | (%) | 15 | | | | | | |
| Coating weight | (g/m$^2$) | 8 | | | | | | |
| Coating method | | Airknife | | | | | | |
| [Backcoat layer] | | | | | | | | |
| Hydrated halloysite A | (part) | — | 30 | 50 | 75 | 100 | — | — |
| Hydrated halloysite B | (part) | — | — | — | — | — | 90 | 100 |
| Delaminated clay | (part) | 90 | 30 | 40 | 15 | — | 10 | — |
| Ground calcium carbonate | (part) | 10 | 40 | 10 | 10 | — | — | — |
| Average equilibrium water content of pigment | (%) | 1.1 | 2.0 | 2.9 | 3.9 | 4.9 | 5.4 | 5.9 |
| Sodium polyaclrylate | (part) | 0.4 | | | | | | |
| Silyl-modified PVA | (part) | 5 | | | | | | |
| Oxidized starch | (part) | — | | | | | | |
| Polyvinyl alcohol | (part) | — | | | | | | |
| Carboxmethylcellulose | (part) | — | | | | | | |
| Styrene.butadiene latex | (part) | 10 | | | | | | |
| Tg of latex | (°C.) | +5 | | | | | | |
| Solid concentration | (%) | 35 | | | | | | |
| Coating weight | (g/m$^2$) | 10 | | | | | | |
| Calendering linear pressure | (kg/cm) | 100 | | | | | | |
| Gas permeability P | (sec) | 1120 | 1171 | 1206 | 1253 | 1555 | 1735 | 1881 |
| Density D | (g/cm$^3$) | 1.10 | 1.11 | 1.11 | 1.11 | 1.11 | 1.12 | 1.12 |
| P/D ratio | | 1018 | 1055 | 1086 | 1129 | 1401 | 1563 | 1679 |
| Relative height of curl (mm) | (HL) | +18 | +8 | +4 | +2 | −4 | −7 | −17 |

TABLE 4-continued

| | | Example 22 | Example 23 | Example 24 | Example 25 | Example 26 | Example 27 | Example 28 |
|---|---|---|---|---|---|---|---|---|
| Relative height of curl (mm) | (HH) | −3 | −1 | 0 | +1 | +1 | +1 | +2 |
| Relative height of curl (mm) | HH - HL | −21 | −9 | −4 | −1 | +5 | +8 | +19 |
| Degree of overlapping ink dot spread | | 1.11 | 1.11 | 1.11 | 1.11 | 1.11 | 1.11 | 1.11 |
| Cockling | | A | A | A | A | A | A | A |
| Stain due to contact with head | | A | A | A | A | A | A | A |
| Strike-through | | 0.16 | 0.16 | 0.15 | 0.14 | 0.14 | 0.14 | 0.14 |

Notes:

Hydrated halloysite A: KA Press manufactured by Oharu Kagaku Kogyosho Co.

Hydrated halloysite B: NAG manufactured by Shinshu Kaolin Co.

Delaminated clay: Nuclay manufactured by Engelhard Co.

Ground calcium carbonate: Softon 2200 manufactured by Bihoku Funka Kogyo Co.

As can be seen from Table 4, when the average equilibrium moisture content of the pigment contained in the backcoat layer is 1.9–5.5%, the resulting ink jet recording sheets are superior in curling properties.

What is claimed is:

1. An ink jet recording sheet which comprises a support comprising a wood pulp and 10% by weight or more of a pigment and one ink-receiving layer on one side of the support, the support having no back-coat layer on the other side of the support, wherein the ratio of gas permeability P according to JIS P8117 to density D according to JIS P8118 of the recording sheet (P/D ratio) is in the range of 25–200.

2. An ink jet recording sheet according to claim 1 wherein the support contains 20% by weight or more of the pigment.

3. A method for producing the ink jet recording sheet of claim 1 wherein the ink-receiving layer is coated by a roll coater or a rod coater.

4. An ink jet recording sheet which comprises a support comprising a wood pulp and 10% by weight or more of a pigment, one ink-receiving layer coated on one side of the support, and one backcoat layer coated on the other side of the support, wherein the ratio of gas permeability P according-to JIS P8117 to density D according to JIS P8118 of the recording sheet (P/D ratio) is in the range of 150–2000.

5. An ink jet recording sheet according to claim 4 wherein a binder of the backcoat layer is a mixture of a synthetic polymer latex having a glass transition temperature of −50° C. to +25° C. and at least one water-soluble binder selected from starch, polyvinyl alcohol and cellulose derivative.

6. An ink jet recording sheet according to claim 5 wherein the synthetic polymer latex has a glass transition temperature of −40° C. to +25° C.

7. An ink jet recording sheet according to claim 4 wherein the backcoat layer comprises a pigment and a binder and average equilibrium moisture content M of said pigment calculated by the following formula is 1.9 to 5.5% by weight:

$$M = \sum_{i=1}^{n} MiWi \quad (1)$$

where M denotes an average equilibrium moisture content (% by weight), i denotes a variable which shows the kind of the pigment, n denotes the number of the kind of the pigments contained ($n \geqq 1$), Mi denotes an equilibrium moisture content of pigment i (% by weight), and Wi denotes a weight ratio of the pigment i to the total pigment ($0 < Wi \leqq 1$).

8. An ink jet recording sheet according to claim 7 wherein the average equilibrium moisture content M of the pigment is 3.0 to 5.0% by weight.

9. A method for producing the ink jet recording sheet of claim 4 wherein the backcoat layer and the ink-receiving layer are coated by a roll coater or a rod coater.

10. The ink jet recording sheet according to claim 4 wherein the back coat layer comprises a pigment and a binder.

* * * * *